US005810673A

United States Patent [19]

Castleberry

[11] Patent Number: 5,810,673

[45] Date of Patent: Sep. 22, 1998

[54] GOLF SWING IMPROVEMENT DEVICE

[76] Inventor: David M. Castleberry, 1342 Palos Verdes #1, San Mateo, Calif. 94403

[21] Appl. No.: 850,609

[22] Filed: May 2, 1997

[51] Int. Cl.[6] ..... A63B 69/36

[52] U.S. Cl. ..... 473/217; 473/273

[58] Field of Search ..... 473/217, 270, 473/273

[56] References Cited

U.S. PATENT DOCUMENTS

| | | | |
|---|---|---|---|
| D. 345,473 | 3/1994 | Grundmann | D6/455 |
| 2,189,613 | 2/1940 | Paulsen | 473/270 |
| 3,606,341 | 9/1971 | Honbarger | 473/217 |
| 4,037,847 | 7/1977 | Lorang | 273/187 B |
| 4,560,165 | 12/1985 | Witteman et al. | 273/183 A |
| 4,629,181 | 12/1986 | Krive | 272/97 |
| 5,062,643 | 11/1991 | Bibbey et al. | 273/188 A |
| 5,318,290 | 6/1994 | Sawyer | 273/26 R |

*Primary Examiner*—George J. Marlo
*Attorney, Agent, or Firm*—Haverstock & Owens LLP

[57] ABSTRACT

A golf-swing training apparatus includes a base, a rotator disk for receiving one foot of a user, and means for anchoring the apparatus to a playing surface. The rotator disk is pivotably coupled to the base by a screw. Friction reducing means is coupled between the rotator disk and the base to reduce rotational friction. Using the apparatus when making a golf swing, the user's foot will rotate on the rotator disk allowing the user to rotate her torso easily with minimal swaying. In addition, the user will be able to lift her heel while keeping the ball of her foot on the rotator disk. The position of the rotator disk can also be adjusted in relation to the position of the tee and the size of the mat. Preferably, a mat slip is utilized to securely anchor the golf swing apparatus to the playing surface of the practice mat without damaging the practice mat. The mat slip can anchor the golf swing apparatus anywhere on the playing surface of the practice mat by sandwiching the practice mat between the base and the mat slip coupled to the base of the apparatus. Further, the golf swing apparatus is a compact apparatus which is easily transportable since all the elements of the apparatus are coupled together.

19 Claims, 5 Drawing Sheets

GOLF SWING IMPROVEMENT DEVICE

FIELD OF THE INVENTION

The present invention relates to the field of athletic skill developing equipment. More particularly, the present invention relates to the field of golf swing trainers and improvement devices.

BACKGROUND OF THE INVENTION

In order to master the game of golf, a player must first conquer the golf swing. Yet, many players fail to perform a proper swing because they do not rotate their body properly. After a player hits the golf ball, in order to properly follow through, the player must rotate her torso and swing her club all the way up, finishing behind her back. At the same time, she must rotate her back foot and allow her heel to come off of the ground while keeping her toes and the ball of her foot on the ground. A player must perform all these movements rhythmically and fluidly while also maintaining proper balance. Otherwise, the player will sway during the swing causing inconsistency when striking the ball. In addition, a player may lose her sense of timing during a swing when she fails to rotate properly. Thus, it is fundamental that a golfer rotate properly and maintain her balance every time she swings.

One way a player can improve her golf-swing is to practice frequently at a driving range and hire a professional instructor to teach her the proper form. However, hiring a professional instructor every time a player practices can be an expensive proposition. Thus, many devices have been created for the purpose of helping beginners and intermediate players to perfect their swings. For example, a golf club that emits a "clicking" sound when being swung has been devised to teach a player proper timing. However, none of those devices helps a user to rotate properly and maintain her balance during the rotation.

U.S. Pat. No. 5,318,290 issued to Sawyer teaches a golf/baseball swing training apparatus that uses a rotational platform for allowing a foot of a user to pivot in conjunction with the platform. In particular, Sawyer teaches a plurality of anchor stakes for anchoring the rotational platform to the ground. This feature, however, is not desirable for use within the driving range, where the players will usually be practicing on a practice mat. Sawyer also teaches embedding the rotational platform within a pair of hinged panel. This feature is also not desirable because the panels are inconvenient to carry around.

Thus, what is needed is a low-cost, easy to use device that can help a player to rotate properly and maintain her balance when rotating, thereby improving her timing and her golf scores. What is further needed is an apparatus that can perform the above functions that is specially designed for use with a practice mat.

SUMMARY OF THE INVENTION

A golf swing training apparatus includes a base, a rotator disk for receiving one foot of a user, and means for anchoring the apparatus to a playing surface. The rotator disk is preferably pivotably coupled to the base by a center screw. A foot strap for holding the foot of the user is attached to the rotator disk by screws and fasteners. The rotator disk allows the user to rotate her torso easily with minimal swaying and the foot strap prevents the user from picking up her foot during the rotation. In the preferred embodiment, a bearing is coupled between the rotator disk and the base to reduce rotational friction. The means for anchoring the apparatus includes a mat slip for clamping to a practice mat. The base, the rotator disk and the washer are made to have minimal thickness such that the rotator disk is substantially level with the playing surface. A non-slip pad is slipped between the foot strap and the rotator disk for further stabilizing the user's foot relative to the rotator disk.

DETAILED DESCRIPTION OF THE PREFERRED EMBODIMENT

Figure 1:
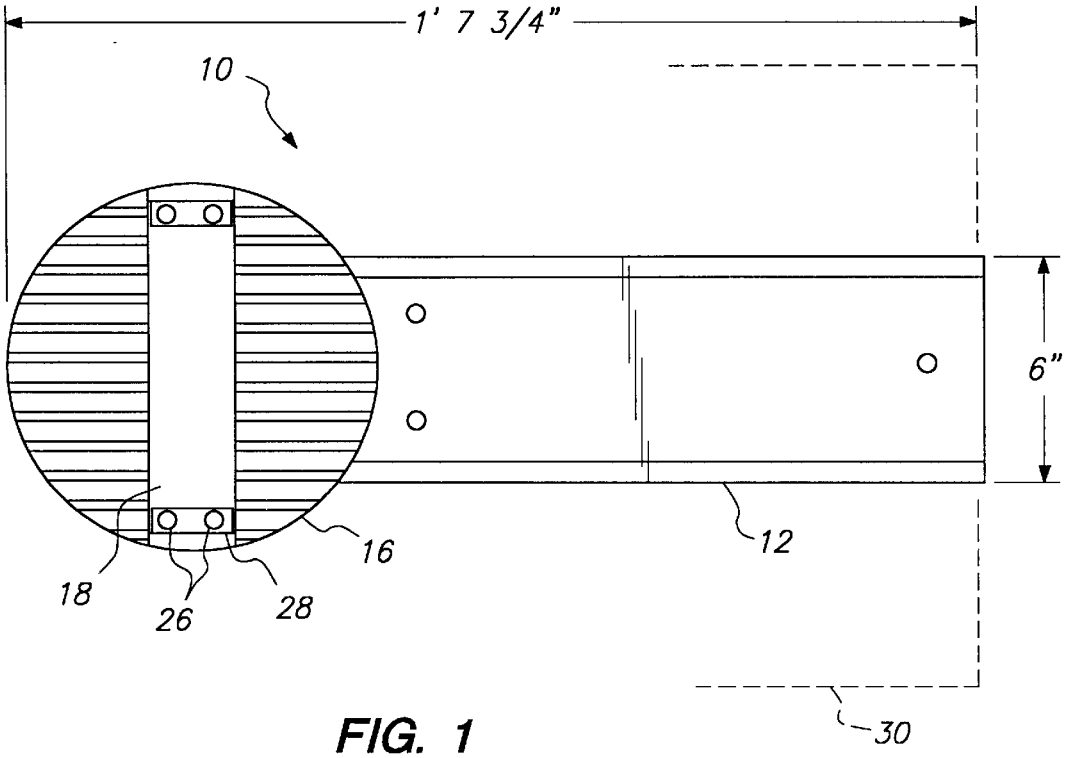
FIG. 1 illustrates a top view of the preferred embodiment of the present invention.
Figure 2:
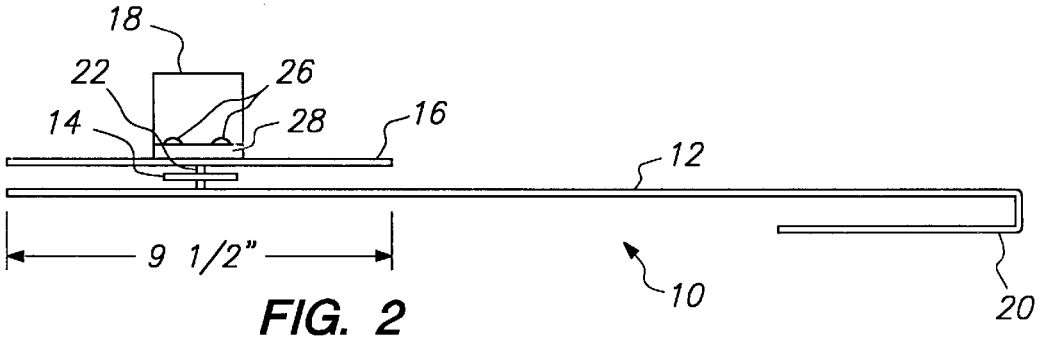
FIG. 2 illustrates a side view of the preferred embodiment of the present invention.

A top view and a side view of the preferred embodiment of the present invention are illustrated in FIGS. 1 and 2. As illustrated in the FIGS. 1 and 2, a rotator disk 16 is pivotably coupled to a base 12 by a center screw 22. Alternately, the center screw can be substituted by a dowel or other fasteners. A washer 14 is coupled between the rotator disk 16 and the base 12 for reducing friction between the rotator disk 16 and the base 12. Other friction reducing means, such as a needle roller bearing 100, can also be used. Preferably, the rotator disk 16 and the washer 14 are made to have a minimal thickness such that the rotator disk 16 is substantially level with the playing surface. The base 12 includes a mat slip 20, which anchors the apparatus 10 to a practice mat 30 by slipping under the practice mat 30 to clamp the practice mat 30 between the mat slip 20 and the base 12.

Preferably, a foot strap 18 is attached across the diameter of the rotator disk 16 to its edges by screws 26 and fasteners 28. The foot strap 18 keeps the ball of the foot on the rotator disk during the golf swing, while allowing the heel of the foot to come off the ground. It is important to note that, in order to allow the user's heel to come off the ground, the foot strap 18 is preferably not tightened over the user's foot. Rather, the foot strap 18 should be loose enough to allow easy ingress and egress by the user. Furthermore, the foot strap 18 is preferably made of a material that is sufficiently resilient that the foot strap 18 does not collapse when the apparatus is not in use.

Figure 3:
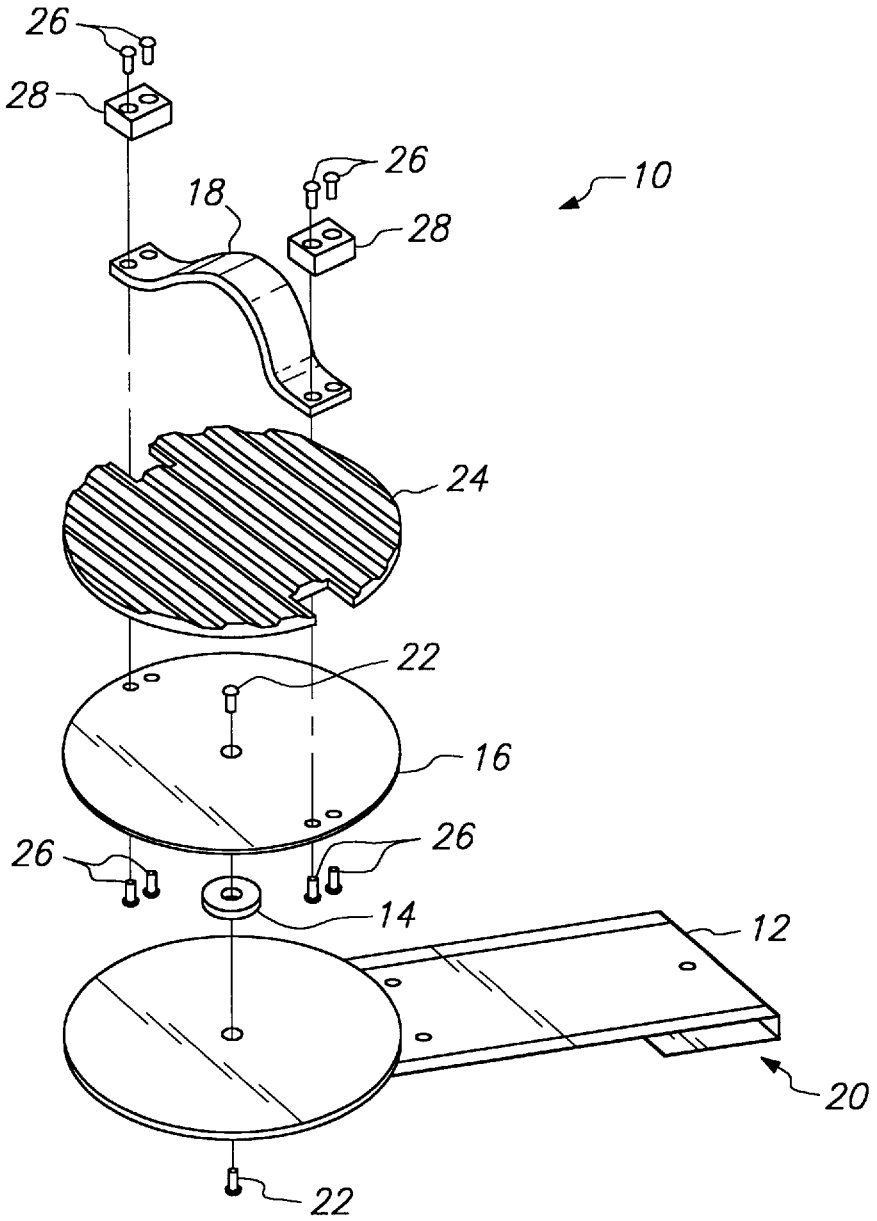
FIG. 3 illustrates an exploded view showing the order of assembly of the preferred embodiment of the present invention.

FIG. 3 illustrates an exploded view showing the order of assembly of the apparatus of the present invention. The reference numerals for identical components of the apparatus are the same as those in FIGS. 1 and 2. A rotator disk 16 is attached to a base 12 by a center screw 22. In the preferred embodiment, a washer 14 is coupled between the rotator disk 16 and the base 12. A foot strap 18 is attached to the rotator disk 16 at its edge by upper screws 26 and fasteners 28. A foot stabilizer mat 24 is inserted between the rotator disk 16 and the foot strap 18. A mat slip 20 is formed by bending an elongated portion of the base 12 into a C-shaped appendage. Alternately, the mat slip 20 may be attached to the base 12 by screws or other fastening means.

Figure 4:
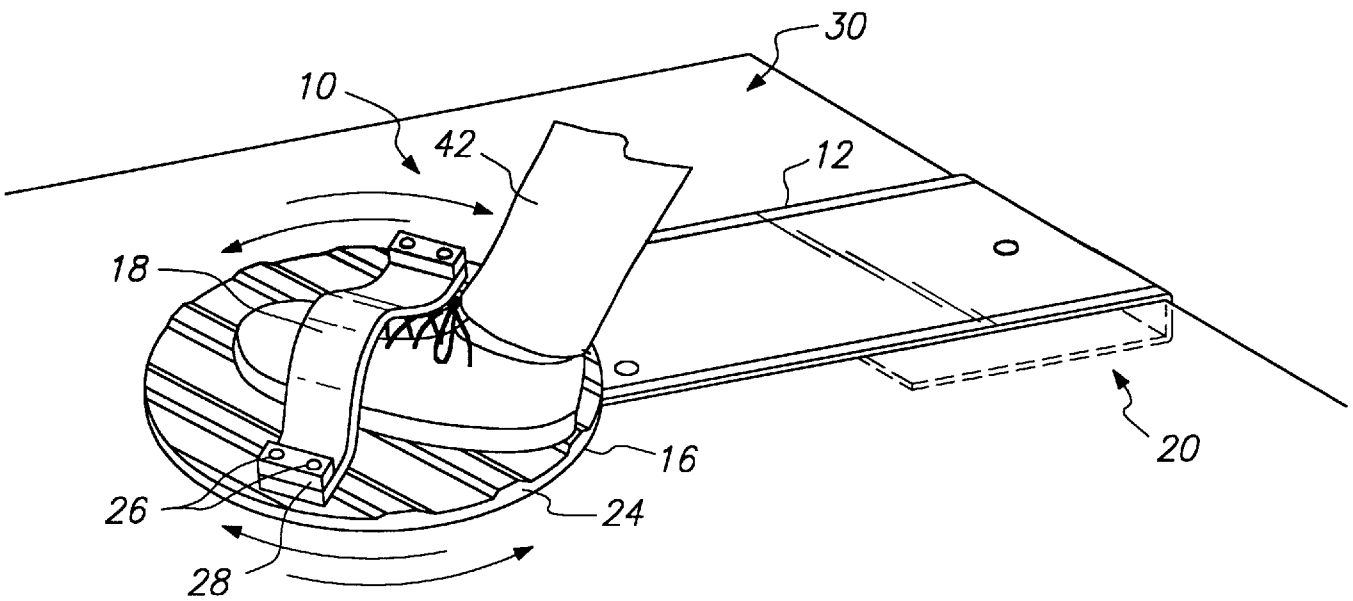
FIG. 4 illustrates the usage of the preferred embodiment of the present invention.

FIG. 4 demonstrates how the apparatus of the present invention is used by a user when practicing the golf swing. An apparatus 10 of the present invention is placed on a practice mat 30, with the mat slip 20 slipped under the practice mat 30. Once the user aligns the apparatus 10 in a proper position, the user then stands on the practice mat 30 with his back foot or turning foot 42 resting on the foot stabilizer mat 24. With her turning foot resting on the rotator disk 16, the user can now easily rotate her torso and keep her body from swaying during her golf swing, thus forcing the user's foot to rotate properly. The apparatus 10 allows the user to freely rotate her foot above the ball of the foot but prevents her from any lateral or sliding motion with that foot. The mat slip 20 is preferred over other means for attaching because the mat slip 20 allows the apparatus to slide on the practice mat 30. This feature is desirable because, once the user has practiced the golf swing several times using the golf-swing improvement apparatus, she may want to practice a few swings without the apparatus. By equipping the apparatus with a mat slip, the user can easily move the apparatus out of her way by sliding the apparatus along an edge of the practice mat 30. When she wants to use the apparatus again, she can easily slide the apparatus back to the original position.

Figure 5:
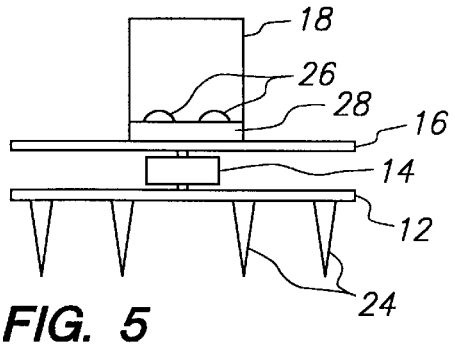
FIG. 5 illustrates a side view of the second embodiment of the present invention.

FIG. 5 illustrates a second embodiment of the present invention. As shown in FIG. 5, a rotator disk 16 is pivotably coupled to a base 12. A washer 14 is coupled between the rotator disk 16 and the base 12. A foot holder 78 is coupled to the rotator disk 16 by a pair of resilient members or spring loaded hinges 80 for a receiving a toe portion of the user's golf shoe 79. The resilient members 80 push the foot holder 78 lightly against the golf shoe 79. It should be noted that the foot holder 78 is only tight enough to hold the toe portion of the golf shoe 79 in position, yet the foot holder 78 is easily releasable to avoid injuring the user. The foot holder 78 should also allow the heel of the golf shoe 79 to lift freely. Preferably, the width of the foot holder 78 is adjustable to accommodate various sizes of shoes.

Figure 6:
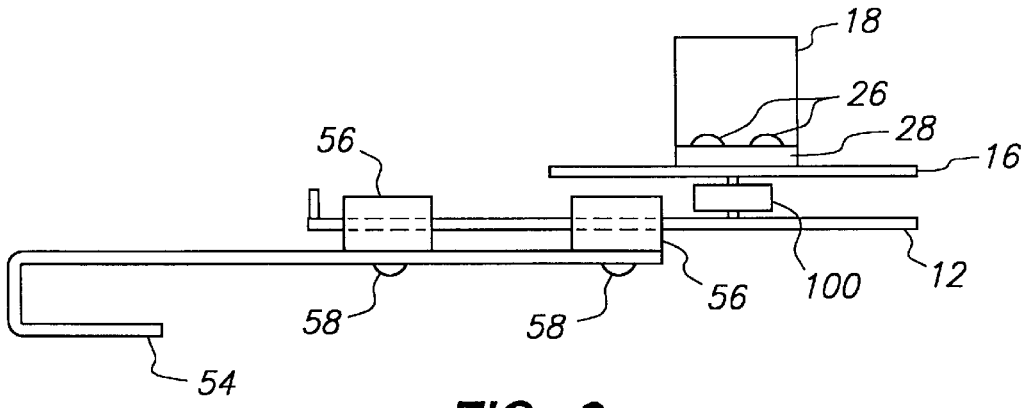
FIG. 6 illustrates a side view of the third embodiment of the present invention.
Figure 7:
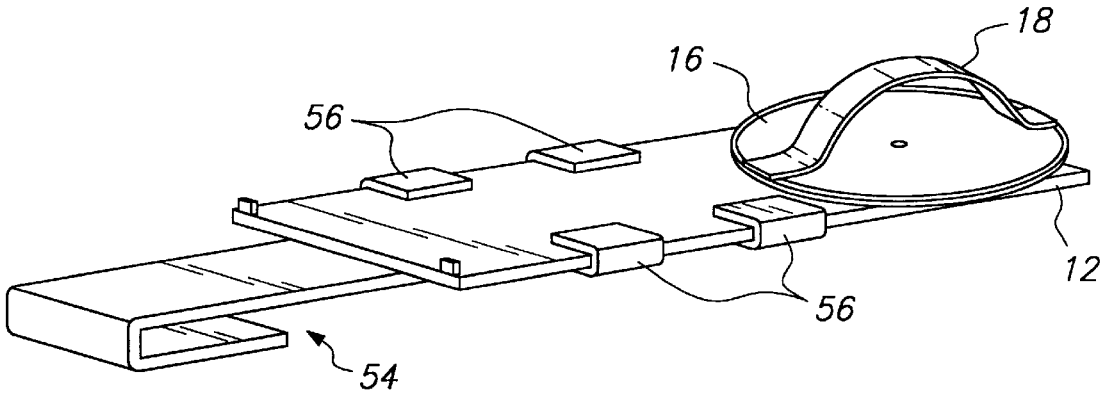
FIG. 7 illustrates an elevated view of the third embodiment of the present invention.
Figure 8:
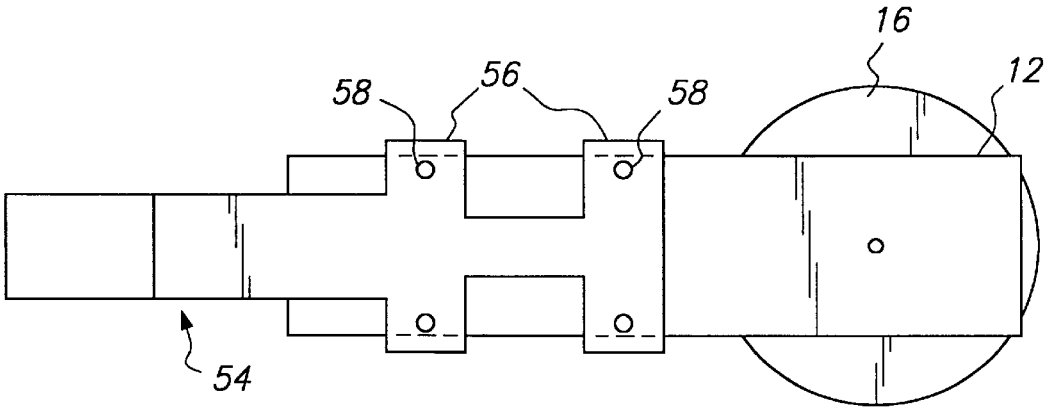
FIG. 8 illustrates a bottom view of the third embodiment of the present invention.

FIGS. 6, 7, and 8 illustrate a side view, a top view and a bottom view of the third embodiment of the present invention. This embodiment is an extendable version of the golf swing training apparatus of the present invention which allows a user to vary the distance between the end of the practice mat and the rotator disk 16. As shown in these figures, a rotator disk 16 is pivotably coupled to a base 12. The mat slip 54 is coupled to the base 12 by a plurality of clamps 56. The clamps 56 are slidable along the base 12, such that the distance between the mat slip 54 and the rotator disk 16 can be adjusted by the user. This feature is desirable so that the position of the rotator disk 16 can be adjusted according to the size of the practice mat 30. The location of each of the clamps 56 can be fixed by tightening a screw 58 once the length of the base 12 is set.

Figure 9:
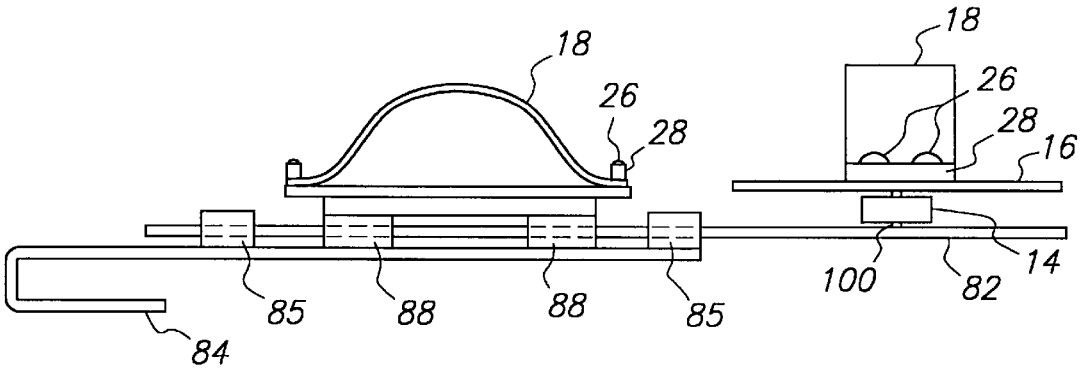
FIG. 9 illustrates a side view of the fourth embodiment of the present invention.
Figure 10:
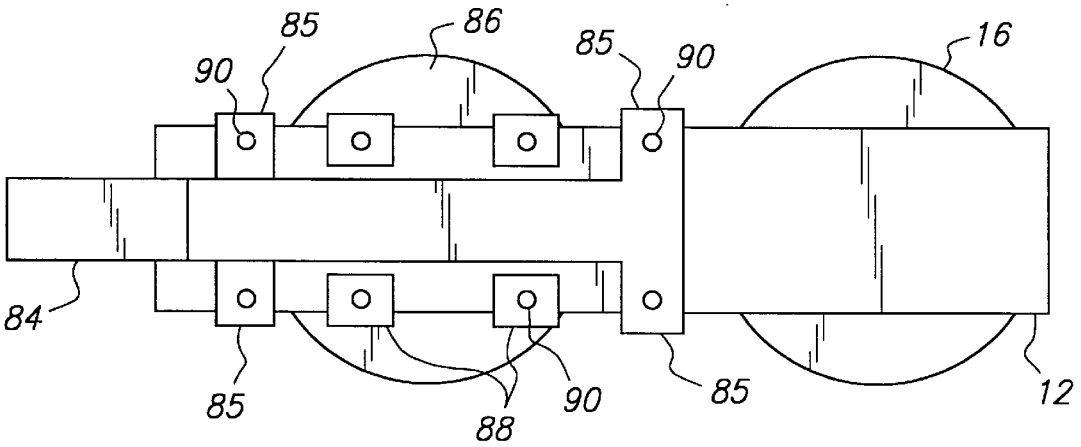
FIG. 10 illustrates a bottom view of the fourth embodiment of the present invention.

FIGS. 9 and 10 illustrate a side view and a bottom view of a fourth embodiment of the present invention. As shown in these figures, a rotator disk 16 is pivotably coupled to a base 12. A washer 14 is coupled between the first rotator disk 16 and the base 12. A platform 86 is coupled to the base 12 by a plurality of clamps 88 for securely holding the user's non-turning foot. Because the platform 86 is for receiving and holding down a non-turning foot of a user, it is not necessary for the platform 86 to be rotatable. The clamps 88 allow the platform 86 to slide along the length of the base 12. Thus, the distance between the platform 86 and the rotator disk 16 can be adjusted according to the preference of the user. A mat slip 84 is coupled to the base 12 by a second plurality of clamps 85. The clamps 85 allow the appendage 84 to slide along the length of the base 82. This feature is desirable so that the position of the rotator disk 16 can be adjusted to accommodate mats of different sizes. The location of each of the clamps 85 and 88 can be fixed by tightening a screw 90 once the desired length is set.

An easy to use, easy to manufacture golf-swing training apparatus has thus been disclosed. The apparatus includes a base, a rotator disk for receiving one foot of a user, and a mat slip for clamping to a practice mat. The mat slip allows the apparatus to slide along an edge of the mat and the extendable base allows the apparatus to fit almost any mats. A means for reducing friction is coupled between the rotator disk and the base to reduce rotational friction. A foot strap is coupled across the top of the rotator disk for preventing the user's foot from stepping out of the golf swing. This apparatus helps the user to maintain her balance through the golf swing and helps the user to rotate synchronously with her swing. The rotating action also keeps the user's body from swaying and improves her swing timing.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A golf swing training apparatus, comprising:

a. a base;

b. rotatable means pivotably coupled to the base and configured to receive a foot of a user for allowing the foot to rotate about an axis; and c. means for removably anchoring the base to a playing surface during use, wherein the means for removably anchoring includes a clamping mechanism.

2. The apparatus according to claim 1 further comprising means for keeping a ball of the foot on the rotatable means while allowing a heel of the foot to be lifted.

3. The apparatus according to claim 2 wherein the means for keeping comprises a leather foot strap coupled to the rotatable means.

4. The apparatus according to claim 2 wherein the means for keeping comprises a pair of spring loaded hinges coupled to the rotatable means.

5. The apparatus according to claim 1 further comprising means for reducing rotation friction positioned between the base and the rotatable means.

6. The apparatus according to claim 1 wherein the means for removably anchoring comprises a mat slip.

7. An apparatus for training a user to perform a golf-swing motion, comprising:

a. a base including a mat slip for coupling to a mat;

b. a rotator disk pivotably coupled to the base for rotation thereon, wherein the rotator disk has a substantially flat surface for a foot of the user to rest upon; and c. friction reducing means coupled between the base and the rotator disk for allowing the rotator disk to rotate smoothly.

8. The apparatus according to claim 7 wherein the base is extendable in a length to accommodate mats of different sizes.

9. The apparatus according to claim 7 wherein the rotator disk and the friction-reducing means are thin such that the substantially flat surface and the mat are substantially level.

10. The apparatus according to claim 7 wherein the friction reducing means comprises a washer.

11. The apparatus according to claim 7 wherein the friction reducing means comprises roller bearings.

12. The apparatus according to claim 7 further comprising means for keeping a ball of the foot on the rotator disk while allowing a heel of the foot to be lifted.

13. The apparatus according to claim 12 wherein the means for keeping comprises a leather foot strap coupled to the rotator disk.

14. The apparatus according to claim 12 wherein the means for keeping comprises a pair of spring-loaded hinges coupled to the rotator disk.

15. A golf swing training apparatus, comprising:

a. a base including a first end portion and a second end portion;

b. a first platform rotatably attached on the first end portion for receiving a turning foot of a user;

c. a second platform mounted on the second end portion for receiving a non-turning foot of the user; and d. means for removably anchoring the apparatus at a predetermined position to a playing surface wherein the means for removably anchoring is coupled to the base.

16. The apparatus according to claim 15 wherein the base is adjustable in length for allowing the means for removably anchoring to extend in a range of distances relative to the base.

17. The apparatus according to claim 15 wherein a distance between the first platform and the second platform is adjustable.

18. The apparatus according to claim 15 further comprising a means for restraining coupled to the first platform for keeping a ball of the turning foot on the first platform while allowing a heel of the turning foot to be lifted when pivoting.

19. The apparatus according to claim 18 wherein the means for restraining comprises a leather foot strap.

* * * * *